US010459363B2

(12) United States Patent
Lin

(10) Patent No.: US 10,459,363 B2
(45) Date of Patent: Oct. 29, 2019

(54) PRINTING EQUIPMENT, ELECTROPHOTOGRAPHIC APPARATUS AND TONER CARTRIDGE UNIT THEREOF

(71) Applicant: Avision Inc., Hsinchu (TW)

(72) Inventor: Chia-Hsin Lin, Hsinchu (TW)

(73) Assignee: AVISION INC., Hsinchu (TW)

( * ) Notice: Subject to any disclaimer, the term of this patent is extended or adjusted under 35 U.S.C. 154(b) by 0 days.

(21) Appl. No.: 16/045,195

(22) Filed: Jul. 25, 2018

(65) Prior Publication Data

US 2019/0079425 A1 Mar. 14, 2019

(30) Foreign Application Priority Data

Sep. 8, 2017 (TW) ..... 106213322 U

(51) Int. Cl.
*G03G 15/00* (2006.01)
*G03G 15/02* (2006.01)
*G03G 15/08* (2006.01)

(52) U.S. Cl.
CPC ..... *G03G 15/0233* (2013.01); *G03G 15/0868* (2013.01); *G03G 2221/0005* (2013.01)

(58) Field of Classification Search
USPC ..... 399/90
See application file for complete search history.

(56) References Cited

U.S. PATENT DOCUMENTS 9,366,985 B1 * 6/2016 Seki ..... G03G 15/0233
2002/0027676 A1 * 3/2002 Okunishi ..... G03G 21/1889 358/1.16
2008/0317499 A1 * 12/2008 Nishimura ..... G03G 21/1821 399/112
2012/0134687 A1 * 5/2012 Jones ..... G03G 15/0863 399/12

FOREIGN PATENT DOCUMENTS

JP 2000047459 A * 2/2000

* cited by examiner

*Primary Examiner* — Quana Grainger
(74) *Attorney, Agent, or Firm* — Sinorica, LLC

(57) ABSTRACT

A printing equipment including a host and a electrophotographic apparatus having an OPC drum unit and a toner cartridge unit is provided. The OPC drum unit has an organic photoconductor, a first memory and a first electrical connector coupled to the organic photoconductor and the first memory. The toner cartridge unit has a developing roller, a second memory and a second electrical connector coupled to the developing roller and the second memory. The first electrical connector is direct contacted to the second electrical connector physically. The host includes a controller, a data carrier transporting module and a third electrical connector coupled to the controller. The third electrical connector is direct contacted to one of the first electrical connector or the second electrical connector physically.

18 Claims, 5 Drawing Sheets

12

14

PRINTING EQUIPMENT, ELECTROPHOTOGRAPHIC APPARATUS AND TONER CARTRIDGE UNIT THEREOF

The current application claims a foreign priority to application number 106213322 filed on Sep. 8, 2017 in Taiwan.

BACKGROUND OF THE INVENTION

Field of the Invention

The present invention relates to a printing equipment, a electrophotographic apparatus and a toner cartridge unit thereof, and more particularly, the present invention is relates to a printing equipment, a electrophotographic apparatus and a toner cartridge unit thereof for electrophotograph.

Description of Related Art

The current printing equipment is equipped with replaceable assemblies in which the replaceable assemblies are, for example, a toner cartridge and an OPC drum (Organic Photoconductor Drum). The above-mentioned replaceable assemblies have a limited useful life, but it is not possible to know the useful life of the replaceable assemblies when the replaceable assemblies are in use. In other words, these replaceable assemblies can not be replaced immediately, thus the printing equipment can not work normally.

In addition, both the toner cartridge and the OPC drum cartridge need to be connected to the external terminal of the printing equipment for allowing the toner cartridge or OPC drum to be electrically connected to the printing equipment. Further, the printing equipment can control the toner cartridge or the OPC drum. Therefore, the printing equipment requires one set of external terminals additionally to be connected to the terminals of the toner cartridge. And, the printing equipment also requires another set of external terminals additionally to be connected to the terminals of OPC drum. However, the configuration of these external terminals will increase the cost of printing equipment. In addition, the configuration of these external terminals also needs configuring spaces for placing. This results the size of printing equipment too large.

SUMMARY OF THE INVENTION

Accordingly, an object of the present invention is to provide a printing equipment, a electrophotographic apparatus and a toner cartridge unit thereof for reducing the manufacturing costs.

Another object of the present invention is to provide a printing equipment, a electrophotographic apparatus and a toner cartridge unit for reducing the overall volume.

To achieve the foregoing and other objects, a printing equipment is provided. The printing equipment includes a electrophotographic apparatus and a host. The electrophotographic apparatus includes an OPC drum unit and a toner cartridge unit. The OPC drum unit has an organic photoconductor, a first memory and a first electrical connector. The first electrical connector is coupled to the organic photoconductor and the first memory. The toner cartridge unit has a developing roller, a second memory and a second electrical connector. The second electrical connector is coupled to the developing roller and the second memory. The first electrical connector is direct contacted to the second electrical connector physically. The host has a controller, a data carrier transporting module and a third electrical connector. The third electrical connector is coupled to the controller. The third electrical connector is direct contacted to one of the first electrical connector and the second electrical connector physically.

From above, in the present invention, the first electrical connector is direct contacted to the second electrical connector physically, and the third electrical connector is direct contacted to one of the first electrical connector and the second electrical connector physically. Therefore, the host of the present invention is just needed to configure with one electrical connector for coupling to the OPC drum unit and the toner cartridge unit. Further, the messages of the OPC drum unit and the toner cartridge unit can be read by the host. Thus, the present invention has less manufacturing costs. In addition, because the host of the present invention just needs less space for achieving the purpose of coupling with the OPC drum unit and the toner cartridge unit, so that the overall volume can be reduced in the present invention.

BRIEF DESCRIPTION OF THE DRAWINGS

Other features and advantages of the present invention will become apparent in the following detailed description of the preferred embodiments with reference to the accompanying drawings, of which.

DESCRIPTION OF EMBODIMENTS

Details of embodiments of the present invention are described with reference to the diagrams.

Figure 1:
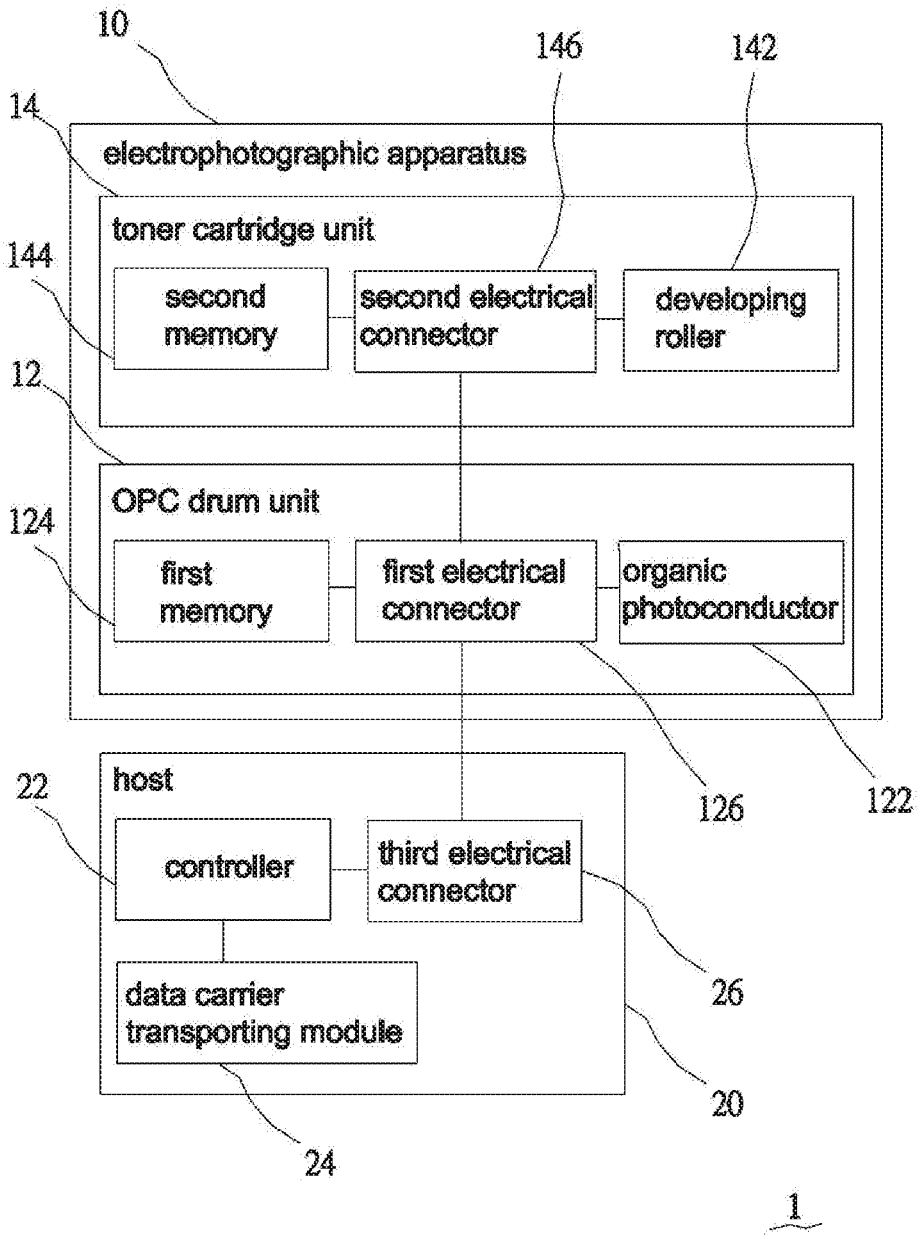
FIG. 1 is a block diagram illustrating a printing equipment according to one embodiment of the present invention.
Figure 2:
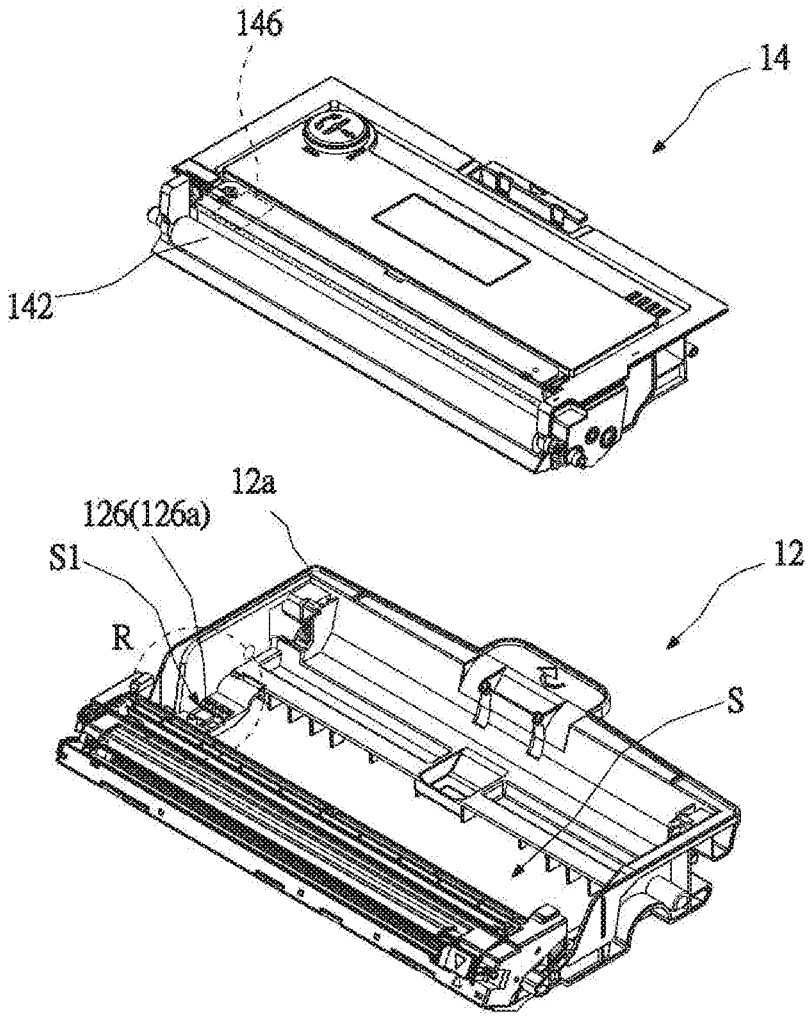
FIG. 2 is an exploded diagram illustrating the electrophotographic apparatus shown in FIG. 1.
Figure 3:
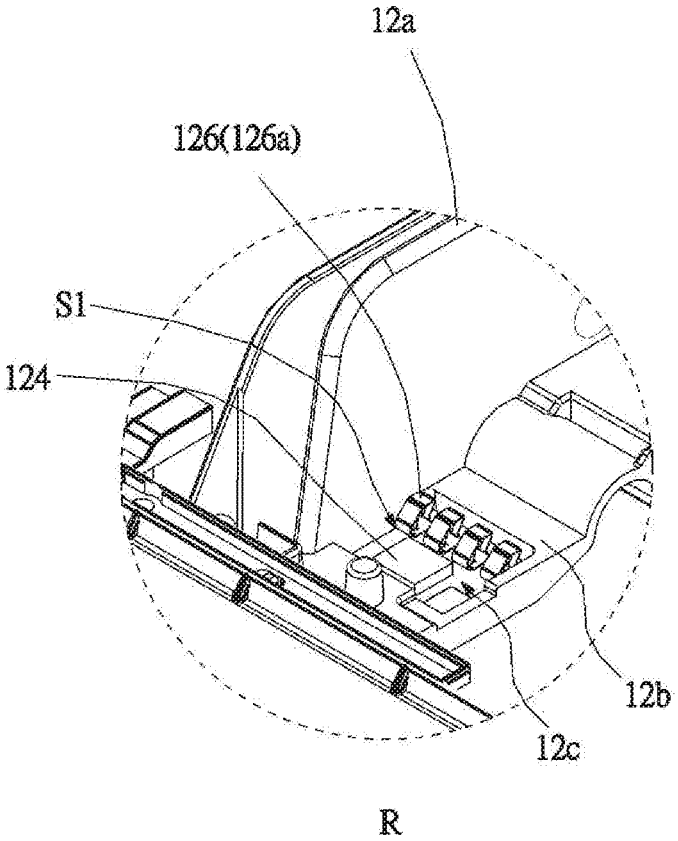
FIG. 3 is an enlarged diagram illustrating R region shown in FIG. 2.
Figure 4:
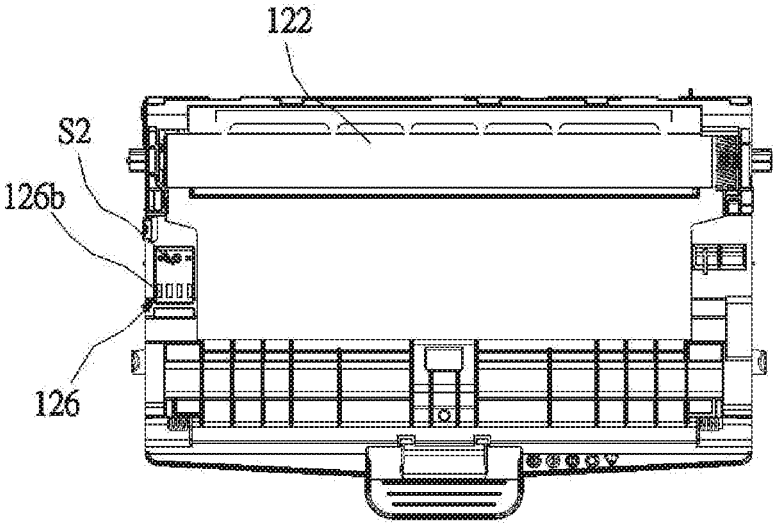
FIG. 4 is a bottom view illustrating the OPC drum unit shown in FIG. 2.
Figure 5:
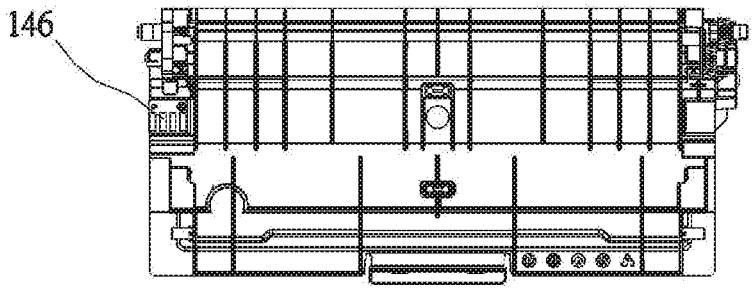
FIG. 5 is a bottom view illustrating the toner cartridge unit shown in FIG. 2.

FIG. 1 is a block diagram illustrating a printing equipment according to one embodiment of the present invention. FIG. 2 is an exploded diagram illustrating the electrophotographic apparatus shown in FIG. 1. FIG. 3 is an enlarged diagram illustrating R region shown in FIG. 2. FIG. 4 is a bottom view illustrating the OPC drum unit shown in FIG. 2. FIG. 5 is a bottom view illustrating the toner cartridge unit shown in FIG. 2. Referring to FIG. 1, FIG. 2, FIG. 3, FIG. 4 and FIG. 5, the printing equipment 1 of the present embodiment includes a electrophotographic apparatus 10 and a host 20. Wherein, the printing equipment 1 of the present embodiment is, for example, printers, copying machines, facsimiles.

From above, the electrophotographic apparatus 10 of the present embodiment includes an OPC drum unit 12 and a toner cartridge unit 14. Wherein, the OPC drum unit 12 has an organic photoconductor 122, a first memory 124 and a first electrical connector 126. The first electrical connector 126 is coupled to the organic photoconductor 122 and the first memory 124. In addition, the toner cartridge unit 14 has a developing roller 142, a second memory 144 and a second electrical connector 146. The second electrical connector 146 is coupled to the developing roller 142 and the second memory 144. Besides, the host 20 has a controller 22, a data carrier transporting module 24 and a third electrical connector 26. The third electrical connector 26 is coupled to the controller 22. In the present embodiment, the host 20 is also coupled to the data carrier transporting module 24 for controlling the operation of the data carrier transporting module 24. For example, the data carrier transporting module 24 is a document transporting roller set.

In the present embodiment, the toner cartridge unit 14 is, for example, assembled in the OPC drum unit 12 for constituting the electrophotographic apparatus 10. Further, the OPC drum unit 12 further includes a frame 12*a*. The frame 12*a* has a disposing space S, and the toner cartridge unit 14 is configured in the disposing space S. The first memory 124 and the first electrical connector 126 are configured inside of the frame 12*a*. In addition, the toner cartridge unit 14 of the present embodiment is coupled to the first electrical connector 126 of the OPC drum unit 12 by the second electrical connector 146. When the toner cartridge unit 14 is assembled in the OPC drum unit 12, the electrophotographic apparatus 10 is coupled to the third electrical connector 26 of the host 20 by the first electrical connector 126 of the OPC drum unit 12. Therefore, the controller 22 of the host 20 controls the OPC drum unit 12 from the third electrical connector 26 through the first electrical connector 126. Certainly, the controller 22 of the host 20 also can control the toner cartridge unit 14 from the third electrical connector 26 through the first electrical connector 126 and the second electrical connector 146. Therefore, the printing equipment 1 of the present embodiment can perform the related electrophotographic operation through the controls of the host 20. The above electrophotographic operations are, for example, charging operation, exposure, developing operation, transferring operation and fusing operation.

Worth mention, in the present embodiment, the first electrical connector 126 is contacted to the second electrical connector 146 directly and physically, and the third electrical connector 26 is contacted to the first electrical connector 126 directly and physically. In detail, the first electrical connector 126 of the present embodiment has a first surface S1 and a second surface S2. Wherein, the first surface S1 is configured with the conductive terminals 126*a*, and the second surface S2 is configured with the conductive pads 126*b*. Therefore, the conductive terminal 126*a* configured on the first surface S1 is contacted to the second electrical connector 146 directly and physically, and the conductive pad 126*b* configured on the second surface S2 is contacted to the third electrical connector 26 directly and physically.

In one embodiment, the OPC drum unit 12 further includes a carrier 12*b*. The carrier 12*b* of the present embodiment is connected to inner side of the frame 12*a*. In addition, the carrier 12*b* is configured with a carrying notch 12*c*, and the first memory 124 and the first electrical connector 126 are configured in the carrying notch 12*c*. Therefore, the electrophotographic apparatus 10 can have the efficacy of light-weight and thin shape by the storage design of the carrier 12*b* and the carrying notch 12*c*.

In order to have a physical connecting relationship and a stable coupling effect among the first electrical connector 126, the second electrical connector 146 and the third electrical connector 26 preferably, the second electrical connector 146 is, for example, like the conductive pad when the first surface S1 is configured with conductive terminal 126*a*. Besides, when the second surface S2 is configured with the conductive pad 126*b*, the third electrical connector 26 is, for example, like the conductive terminal. In other words, when the surface of the first electrical connector 126 contacted to the second electrical connector 146 physically is configured with one set of conductive pads or conductive terminals, the second electrical connector 146 is configured with another set of conductive pads or conductive terminals.

In addition, although the first electrical connector 126 of the electrophotographic apparatus 10 in the present embodiment is connected to the third electrical connector 26 of the host 20 directly and physically, but the second electrical connector 146 of the electrophotographic apparatus 10 in other preferred embodiment also can be contacted to the third electrical connector 26 of the host 20 directly and physically, and the present invention will not be limited to this. Further, where the first electrical connector 126 of the OPC drum unit 12 is contacted to the second electrical connector 146 of the toner cartridge unit 14 directly and physically, and the electrical connector (the first electrical connector 126 or the second electrical connector 146) of the electrophotographic apparatus 10 is contacted to the third electrical connector 26 of the host 20 directly and physically is within the spirit and scope of the present invention, and is not intended to be limiting herein.

When the first electrical connector 126 is direct contacted to the second electrical connector 146 of the toner cartridge unit 14 physically, projection area of the first electrical connector 126 projected on the toner cartridge unit 14 is, for example, overlapped with the second electrical connector 146. Similarly, when the first electrical connector 126 is direct contacted to the third electrical connector 26 of the host 20 physically, projection area of the first electrical connector 126 projected on the host 20 is, for example, overlapped with the third electrical connector 26.

On another hand, in the present embodiment, the first memory 124 of the OPC drum unit 12 is stored with an OPC drum unit message, and the second memory 144 of the toner cartridge unit 14 is stored with a toner cartridge unit message. Wherein, the OPC drum unit message is the manufacturer information and the using information of the OPC drum unit. The OPC drum unit message is, for example, manufacturer name and life information of the organic photoconductor 122. In addition, the toner cartridge unit message is the manufacturer information and the using information of the toner cartridge unit. The toner cartridge unit message is, for example, manufacturer name and life information of the toner cartridge unit 14. Therefore, the controller 22 of the present embodiment can read the OPC drum unit message stored in the first memory 124 from the third electrical connector 26 through the first electrical connector 126. Certainly, the controller 22 also can read the toner cartridge unit message stored in the second memory 144 from the third electrical connector 26 through the second electrical connector 146. Thus, the host 20 can get messages of the OPC drum unit 12 and the toner cartridge unit 14 through the reading operations for application in use or design.

Further, in order to control the using life of the OPC drum unit 12 and the toner cartridge unit 14 effectively, the controller 22 of the present embodiment can record the operations of the organic photoconductor 122 through the third electrical connector 26 and the first electrical connector 126, and then updates the OPC drum unit message. In detail, the controller 22 can record the number of laps the organic photoconductor 122 rotates to be the reference of using life of the OPC drum unit. Similarly, the controller 22 can records the operation of the developing roller 142 through the third electrical connector 26, the first electrical connector 126 and the second electrical connector 146, and then updates the toner cartridge unit message. In detail, the controller 22 can record the number of laps the developing roller 142 rotates to be the reference of using life of the toner cartridge unit.

To sum up, in the present invention, the first electrical connector is direct contacted to the second electrical connector physically, and the third electrical connector is direct contacted to one of the first electrical connector and the second electrical connector physically. Therefore, the host of the present invention is just need to configure with one electrical connector for coupling to the OPC drum unit and the toner cartridge unit. Further, the host can read the messages of the OPC drum unit and the toner cartridge unit. Thus, the present invention has less manufacturing costs. In addition, because the host of the present invention just needs less space for achieving the purpose of coupling with the OPC drum unit and the toner cartridge unit, so that the overall volume can be reduced in the present invention.

On another hand, the present invention can use the electrical connector of the host to contact the electrical connector of one of the OPC drum unit and the toner cartridge unit physically. Because the electrical connector of the OPC drum unit has contacted to the electrical connector of the toner cartridge unit physically, so that the host can read the messages of the OPC drum unit and the toner cartridge unit, and then updates the messages stored in the OPC drum unit and the toner cartridge unit when the OPC drum unit and the toner cartridge unit completes the corresponding operation.

While the disclosure has been described by way of example and in terms of the preferred embodiments, it is to be understood that the disclosure is not limited to the disclosed embodiments. To the contrary, it is intended to cover various modifications and similar arrangements (as would be apparent to those skilled in the art). Therefore, the scope of the appended claims should be accorded the broadest interpretation so as to encompass all such modifications and similar arrangements.

What is claimed is:

1. A printing equipment, comprising:

a electrophotographic apparatus including an OPC drum unit and a toner cartridge unit, the OPC drum unit has an organic photoconductor, a first memory and a first electrical connector, the first electrical connector is coupled to the organic photoconductor and the first memory, the toner cartridge unit has a developing roller, a second memory and a second electrical connector, the second electrical connector is coupled to the developing roller and the second memory, wherein the first electrical connector is contacted to the second electrical connector directly and physically; and a host including a controller, a data carrier transporting module and a third electrical connector, the third electrical connector is coupled to the controller, wherein the third electrical connector is contacted to one of the first electrical connector or the second electrical connector directly and physically;

wherein the first electrical connector has a first surface and a second surface, the first surface is configured with conductive terminals, the second surface is configured with conductive pads, and the conductive terminals of the first surface are contacted to the second electrical connector directly and physically, the conductive pads of the second surface are contacted to the third electrical connector directly and physically.

2. The printing equipment of claim 1, wherein one surface of the first electrical connector contacted to the second electrical connector physically is configured with one set of conductive pads or conductive terminals, and the second electrical connector is configured with another set of conductive pads or conductive terminals.

3. The printing equipment of claim 1, wherein the first memory is stored with an OPC drum unit message, the second memory is stored with a toner cartridge unit message, and the controller reads the OPC drum unit message stored in the first memory from the third electrical connector through the first electrical connector, the controller reads the toner cartridge unit message stored in the second memory from the third electrical connector through the second electrical connector, the OPC drum unit message includes manufacturer information and life information of the organic photoconductor, the toner cartridge unit message includes manufacturer information and life information of the toner cartridge unit.

4. The printing equipment of claim 1, wherein the controller records operations of the organic photoconductor through the third electrical connector and the first electrical connector, and updates the OPC drum unit message, the controller records operations of the developing roller through the third electrical connector and the second electrical connector, and updates the toner cartridge unit message.

5. The printing equipment of claim 1, wherein when the first electrical connector contacts to the second electrical connector of the toner cartridge unit physically, a projection area of the first electrical connector projected on the toner cartridge unit is overlapped with the second electrical connector, when the first electrical connector contacts to the third electrical connector of the host physically, a projection area of the first electrical connector projected on the host is overlapped with the third electrical connector.

6. The printing equipment of claim 1, wherein the OPC drum unit further comprises a frame, the frame has a disposing space, and the toner cartridge unit is configured at the disposing space, and the first memory and the first electrical connector are configured inside of the frame.

7. The printing equipment of claim 6, wherein the OPC drum unit further comprises a carrier connected to inner side of the frame, the carrier has a carrying notch, and the first memory and the first electrical connector are configured in the carrying notch.

8. A electrophotographic apparatus configured in a printing host, the printing host has a controller, a data carrier transporting module and a third electrical connector, the third electrical connector is coupled to the controller, comprising:

an OPC drum unit having an organic photoconductor, a first memory and a first electrical connector, the first electrical connector is coupled to the organic photoconductor and the first memory; and a toner cartridge unit having a developing roller, a second memory and a second electrical connector, the second electrical connector is coupled to the developing roller and the second memory, wherein, the first electrical connector is contacted to the second electrical connector directly and physically;

wherein the first electrical connector has a first surface and a second surface, the first surface is configured with conductive terminals, the second surface is configured with conductive pads, and the conductive terminals of the first surface are contacted to the second electrical connector directly and physically, the conductive pads of the second surface are contacted to the third electrical connector directly and physically.

9. The electrophotographic apparatus of claim 8, wherein one surface of the first electrical connector contacted to the second electrical connector physically is configured with one set of conductive pads or conductive terminals, and the second electrical connector is configured with another set of conductive pads or conductive terminals.

10. The electrophotographic apparatus of claim 8, wherein the first memory is stored with an OPC drum unit message, the second memory is stored with a toner cartridge unit message, and the controller reads the OPC drum unit message stored in the first memory from the third electrical connector through the first electrical connector, the controller reads the toner cartridge unit message stored in the second memory from the third electrical connector through the second electrical connector, the OPC drum unit message includes manufacturer information and life information of the organic photoconductor, the toner cartridge unit message includes manufacturer information and life information of the toner cartridge unit.

11. The electrophotographic apparatus of claim 8, wherein the controller records operations of the organic photoconductor through the third electrical connector and the first electrical connector, and updates the OPC drum unit message, the controller records operations of the developing roller through the third electrical connector and the second electrical connector, and updates the toner cartridge unit message.

12. The electrophotographic apparatus of claim 8, wherein when the first electrical connector contacts to the second electrical connector of the toner cartridge unit physically, a projection area of the first electrical connector projected on the toner cartridge unit is overlapped with the second electrical connector, when the first electrical connector contacts to the third electrical connector of the host physically, a projection area of the first electrical connector projected on the host is overlapped with the third electrical connector.

13. The electrophotographic apparatus of claim 8, wherein the OPC drum unit further comprises a frame, the frame has a disposing space, and the toner cartridge unit is configured at the disposing space, and the first memory and the first electrical connector are configured inside of the frame.

14. The electrophotographic apparatus of claim 13, wherein the OPC drum unit further comprises a carrier connected to inner side of the frame, the carrier has a carrying notch, and the first memory and the first electrical connector are configured in the carrying notch.

15. A toner cartridge unit configured in an OPC drum unit, the OPC drum unit has an organic photoconductor, a first memory and a first electrical connector, the first electrical connector is coupled to the organic photoconductor and the first memory, comprising:

a developing roller;

a second memory; and a second electrical connector coupled to the developing roller and the second memory, wherein, the first electrical connector is contacted to the second electrical connector directly and physically;

wherein, the first electrical connector has a first surface and a second surface, the first surface is configured with conductive terminals, the second surface is configured with conductive pads, and the conductive terminals of the first surface are contacted to the second electrical connector directly and physically.

16. The toner cartridge unit of claim 15, wherein one surface of the first electrical connector contacted to the second electrical connector physically is configured with one set of conductive pads or conductive terminals, and the second electrical connector is configured with another set of conductive pads or conductive terminals.

17. The toner cartridge unit of claim 15, wherein the first memory is stored with an OPC drum unit message, the second memory is stored with a toner cartridge unit message, the OPC drum unit message includes manufacturer information and life information of the organic photoconductor, the toner cartridge unit message includes manufacturer information and life information of the toner cartridge unit.

18. The toner cartridge unit of claim 15, wherein when the first electrical connector contacts to the second electrical connector of the toner cartridge unit physically, a projection area of the first electrical connector projected on the toner cartridge unit is overlapped with the second electrical connector.

* * * * *